US007354502B2

(12) United States Patent
Polat et al.

(10) Patent No.: US 7,354,502 B2
(45) Date of Patent: Apr. 8, 2008

(54) METHOD FOR MAKING A FIBROUS STRUCTURE COMPRISING CELLULOSIC AND SYNTHETIC FIBERS

(75) Inventors: Osman Polat, Montgomery, OH (US); Timothy Jude Lorenz, Cincinnati, OH (US); Dean Phan, West Chester, OH (US); Paul Dennis Trokhan, Hamilton, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 612 days.

(21) Appl. No.: 10/740,260

(22) Filed: Dec. 18, 2003

(65) Prior Publication Data

US 2004/0154763 A1 Aug. 12, 2004

Related U.S. Application Data

(63) Continuation-in-part of application No. 10/360,038, filed on Feb. 6, 2003, now Pat. No. 7,052,580, and a continuation-in-part of application No. 10/360,021, filed on Feb. 6, 2003, now Pat. No. 7,067,038.

(51) Int. Cl.

| | |
|---|---|
| ***D21H 13/10*** | (2006.01) |
| ***D21H 27/02*** | (2006.01) |
| ***B31F 1/00*** | (2006.01) |
| ***B31F 1/12*** | (2006.01) |

(52) U.S. Cl. ..... 162/146; 162/111; 162/117; 162/129; 162/109; 162/116; 162/211; 162/157.1

(58) Field of Classification Search ..... 162/109, 162/111–113, 117, 123–131, 146, 141, 157.1, 162/204–207, 158, 116, 211

See application file for complete search history.

(56) References Cited

U.S. PATENT DOCUMENTS

| | | | | |
|---|---|---|---|---|
| 3,034,180 A | | 5/1962 | Greiner | |
| 3,301,746 A | | 1/1967 | Sanford et al. | |
| 3,473,576 A | | 10/1969 | Amneus | |
| 3,573,164 A | | 3/1971 | Friedberg et al. | |
| 3,812,000 A | | 5/1974 | Salvucci, Jr. et al. | |
| 3,821,068 A | | 6/1974 | Salvucci, Jr. et al. | |
| 3,879,257 A | | 4/1975 | Gentile et al. | |
| 3,947,315 A | | 3/1976 | Smith | |
| 3,974,025 A | | 8/1976 | Ayers | |
| 3,984,898 A | * | 10/1976 | Matsumura et al. | 425/81.1 |
| 3,994,771 A | | 11/1976 | Morgan, Jr. et al. | |
| 4,166,001 A | | 8/1979 | Dunning et al. | |
| 4,191,609 A | | 3/1980 | Trokhan | |
| 4,202,959 A | | 5/1980 | Henbest et al. | |
| 4,208,459 A | | 6/1980 | Becker et al. | |
| 4,239,065 A | | 12/1980 | Trokhan | |
| 4,300,981 A | | 11/1981 | Carstens | |
| 4,486,268 A | | 12/1984 | Nuttall et al. | |
| 4,487,796 A | | 12/1984 | Lloyd et al. | |
| 4,528,239 A | | 7/1985 | Trokhan | |
| 4,637,859 A | | 1/1987 | Trokhan | |
| 4,741,941 A | | 5/1988 | Englebert et al. | |
| 4,755,421 A | * | 7/1988 | Manning et al. | 442/338 |
| 4,942,077 A | | 7/1990 | Wendt et al. | |
| 5,094,717 A | * | 3/1992 | Manning et al. | 162/111 |
| 5,102,501 A | * | 4/1992 | Eber et al. | 162/129 |
| 5,178,729 A | | 1/1993 | Janda | |
| 5,245,025 A | | 9/1993 | Trokhan et al. | |
| 5,284,703 A | | 2/1994 | Everhart et al. | |
| 5,389,202 A | | 2/1995 | Everhart et al. | |
| 5,405,499 A | | 4/1995 | Vinson | |
| 5,409,572 A | * | 4/1995 | Kershaw et al. | 162/109 |
| 5,494,554 A | | 2/1996 | Edwards et al. | |
| 5,516,580 A | | 5/1996 | Frenette et al. | |
| 5,527,428 A | | 6/1996 | Trokhan et al. | |
| 5,538,595 A | | 7/1996 | Trokhan et al. | |
| 5,580,423 A | | 12/1996 | Ampulski et al. | |
| 5,582,685 A | | 12/1996 | Vinson | |
| 5,667,636 A | | 9/1997 | Engel et al. | |
| 5,672,248 A | | 9/1997 | Wendt et al. | |

(Continued)

FOREIGN PATENT DOCUMENTS

EP 0 080 382 B1 8/1988

(Continued)

OTHER PUBLICATIONS

"Coarseness of Pulp Fibers", T 234 cm-02, © 2002 TAPPI, pp. 1-6.

(Continued)

*Primary Examiner*—José A. Fortuna
(74) *Attorney, Agent, or Firm*—C. Brant Cook; David M. Weirich; Betty J. Zea

(57) ABSTRACT

A method for making a fibrous structure, the method comprising the steps of: providing a mixture of synthetic fibers and short cellulosic fibers onto a forming member so as to form one or more layers including the mixture of synthetic fibers and short cellulosic fibers; providing a plurality of long cellulosic fibers onto the mixture of synthetic fibers and short cellulosic fibers so as to form one or more layers including predominantly long cellulosic fibers; and forming a unitary fibrous structure including the one or more layers including the mixture of synthetic fibers and short cellulosic fibers and one or more layers including predominantly long cellulosic fibers.

18 Claims, 5 Drawing Sheets

U.S. PATENT DOCUMENTS

| | | | | |
|---|---|---|---|---|
| 5,804,036 | A | 9/1998 | Phan et al. | |
| 5,888,347 | A | 3/1999 | Engel et al. | |
| 5,916,507 | A * | 6/1999 | Dabi et al. | 264/113 |
| 5,935,880 | A | 8/1999 | Wang et al. | |
| 5,961,757 | A | 10/1999 | Trombetta et al. | |
| 5,989,682 | A | 11/1999 | Anderson | |
| 5,990,377 | A | 11/1999 | Chen et al. | |
| 6,017,417 | A | 1/2000 | Wendt et al. | |
| 6,039,839 | A | 3/2000 | Trokhan et al. | |
| 6,103,061 | A | 8/2000 | Anderson et al. | |
| 6,110,324 | A | 8/2000 | Trokhan et al. | |
| 6,110,848 | A | 8/2000 | Bouchette | |
| 6,117,270 | A | 9/2000 | Trokhan | |
| 6,129,815 | A * | 10/2000 | Larson et al. | 162/112 |
| 6,171,447 | B1 | 1/2001 | Trokhan | |
| 6,207,012 | B1 | 3/2001 | Oriaran et al. | |
| 6,241,850 | B1 | 6/2001 | Kelly | |
| 6,277,241 | B1 * | 8/2001 | Merker et al. | 162/111 |
| 6,328,850 | B1 * | 12/2001 | Phan et al. | 162/123 |
| 6,361,654 | B1 | 3/2002 | Chuang et al. | |
| 6,368,609 | B1 * | 4/2002 | Fontenot et al. | 424/404 |
| 6,451,099 | B1 * | 9/2002 | Miyamoto et al. | 106/31.86 |
| 6,534,151 | B2 | 3/2003 | Merker | |
| 6,576,091 | B1 * | 6/2003 | Cabell et al. | 162/348 |
| 6,752,905 | B2 * | 6/2004 | Hu et al. | 162/135 |
| 6,841,038 | B2 | 1/2005 | Horenziak et al. | |
| 6,861,380 | B2 | 3/2005 | Garnier et al. | |
| 6,887,350 | B2 * | 5/2005 | Garnier et al. | 162/135 |
| 7,052,580 | B2 * | 5/2006 | Trokhan et al. | 162/109 |
| 7,067,038 | B2 * | 6/2006 | Trokhan et al. | 162/109 |
| 2002/0112830 | A1 | 8/2002 | Bakken et al. | |
| 2002/0180092 | A1 | 12/2002 | Bednarz et al. | |
| 2004/0087237 | A1 * | 5/2004 | Garnier et al. | 442/413 |
| 2004/0112558 | A1 * | 6/2004 | Garnier et al. | 162/129 |
| 2004/0154763 | A1 * | 8/2004 | Polat et al. | 162/129 |
| 2004/0154767 | A1 * | 8/2004 | Trokhan et al. | 162/146 |
| 2004/0154768 | A1 * | 8/2004 | Trokhan et al. | 162/146 |
| 2004/0154769 | A1 | 8/2004 | Lorenz et al. | |
| 2004/0157515 | A1 | 8/2004 | Lorenz et al. | |
| 2004/0157524 | A1 * | 8/2004 | Polat et al. | 442/390 |
| 2006/0180287 | A1 * | 8/2006 | Trokhan et al. | 162/146 |

FOREIGN PATENT DOCUMENTS

| | | |
|---|---|---|
| EP | 0 616 074 A1 | 9/1994 |
| EP | 1 236 827 A1 | 9/2002 |
| WO | WO 93/14267 | 7/1993 |
| WO | WO 00/20675 | 4/2000 |
| WO | WO 00/39394 | 7/2000 |

OTHER PUBLICATIONS

"Fiber Length of Pulp and Paper By Automated Optical Analyzer Using Polarized Light", T 271 om-02, © 2002 TAPPI, pp. 1-6.

U.S. Appl. No. 10/360,038, filing date Feb. 6, 2003, Paul Dennis Trokhan et al.

U.S. Appl. No. 10/360,021, filing date Feb. 6, 2003, Paul Dennis Trokhan et al.

* cited by examiner

METHOD FOR MAKING A FIBROUS STRUCTURE COMPRISING CELLULOSIC AND SYNTHETIC FIBERS

CROSS REFERENCE TO RELATED APPLICATIONS

The present application is a continuation-in-part of U.S. Application Ser. No. 10/360,038, filed Feb. 6, 2003, now U.S. Pat. No. 7,052,580, and a continuation-in-part of U.S. application Ser. No. 10/360,021, filed Feb. 6,2003, now U.S. Pat. No. 7,067,038.

FIELD OF THE INVENTION

The present invention relates to fibrous structures comprising cellulose fibers and synthetic fibers in combination, and more specifically to fibrous structures having at least one layer including short cellulosic fibers mixed with synthetic fibers and at least one layer including predominantly long cellulosic fibers.

BACKGROUND OF THE INVENTION

Fibrous structures, such as paper webs, are well known in the art and are in common use today for paper towels, toilet tissue, facial tissue, napkins, wet wipes, and the like. Typical tissue paper is comprised predominantly of cellulosic fibers, often wood-based. Despite a broad range of cellulosic fiber types, such fibers are generally high in dry modulus and relatively large in diameter, which may cause their flexural rigidity to be higher than desired for some uses. Further, cellulosic fibers can have a relatively high stiffness when dry, which may negatively affect the softness of the product and may have low stiffness when wet, which may cause poor absorbency of the resulting product.

To form a web, the fibers in typical disposable paper products are bonded to one another through chemical interaction and often the bonding is limited to the naturally occurring hydrogen bonding between hydroxyl groups on the cellulose molecules. If greater temporary or permanent wet strength is desired, strengthening additives can be used. These additives typically work by either covalently reacting with the cellulose or by forming protective molecular films around the existing hydrogen bonds. However, they can also produce relatively rigid and inelastic bonds, which may detrimentally affect softness and absorption properties of the products.

The use of synthetic fibers along with cellulose fibers can help overcome some of the previously mentioned limitations. Synthetic polymers can be formed into fibers with a range of diameters, including very small fibers. Further, synthetic fibers can be formed to be lower in modulus than cellulose fibers. Thus, a synthetic fiber can be made with very low flexural rigidity, which facilitates good product softness. In addition, functional cross-sections of the synthetic fibers can be micro-engineered. Synthetic fibers can also be designed to maintain modulus when wetted, and hence webs made with such fibers may resist collapse during absorbency tasks. Further, the use of synthetic fibers can help aid in the formation of a web and/or its uniformity. Accordingly, the use of thermally bonded synthetic fibers in tissue products can result in a strong network of highly flexible fibers (good for softness) joined with water-resistant high-stretch bonds (good for softness and wet strength). However, synthetic fibers can be relatively expensive as compared to cellulose fibers. Thus, it may be desired to include only as many synthetic fibers as are necessary to gain the desired benefits that the fibers provide. We have found that mixing short cellulosic fibers with synthetic fibers can help aid the dispersion of the synthetic fibers and thus may provide, individually or in combination with each other, many of the benefits of the synthetic fibers while requiring fewer (or smaller amounts of) synthetic fibers in the web than if no short cellulosic fibers were mixed in.

Thus, it would be advantageous to provide improved fibrous structures including cellulosic and synthetic fibers in combination, and processes for making such fibrous structures. It would also be advantageous to provide a product that has synthetic fibers concentrated in certain desired portions of the resulting web and a method to allow for such non-random placement of such fibers. It would also be advantageous to have a product and method of making a product including short cellulosic fibers and synthetic fibers disposed in at least one layer and longer fibers disposed predominantly in one or more other layers.

SUMMARY OF THE INVENTION

To address the problems with respect to the prior art, we have invented a method for making a fibrous structure, the method comprising the steps of: providing a mixture of synthetic fibers and short cellulosic fibers onto a forming member so as to form one or more layers including the mixture of synthetic fibers and short cellulosic fibers; providing a plurality of long cellulosic fibers onto the mixture of synthetic fibers and short cellulosic fibers so as to form one or more layers including predominantly long cellulosic fibers; and forming a unitary fibrous structure including the one or more layers including the mixture of synthetic fibers and short cellulosic fibers and one or more layers including predominantly long cellulosic fibers.

DETAILED DESCRIPTION OF THE INVENTION

Figure 1:
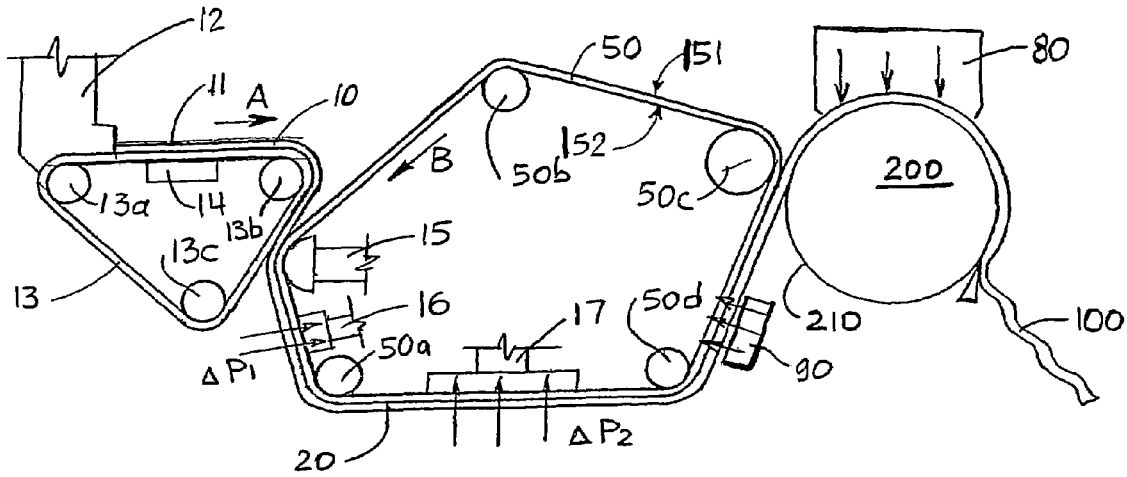
FIG. 1 is a schematic side view of an embodiment of the process of the present invention.

As used herein, the following terms have the following meanings.

"Average cellulosic fiber width" is the average fiber width of a cellulosic fiber as measured by Kajaani FiberLab equipment available from Metso Automation Kajaani, Ltd., Narcoss, Ga.

"Average synthetic fiber diameter" is the average fiber diameter of a synthetic fiber derived from the following equation: average synthetic fiber diameter=square root of (Mass Denier×K/density), where Mass Denier is the mass portion only (grams) of the Denier of a fiber (e.g. a 3 Denier fiber is 3 g/9000 m, but the Mass Denier of that fiber is 3 g) and K=141.5 The constant K=141.5 is for cylindrical fibers. For non-cylindrical fibers, a different constant $K_1$ must be recalculated using the non-cylindrical cross-sectional area of the fibers. Thus, the fiber diameter will have units of micrometers.

"Coarseness" is defined as the weight per unit length of fiber expressed as milligrams per 100 m, as set forth in TAPPI Method T 234 cm-02.

"Co-joined fibers" means two or more fibers that have been fused or adhered to one another by melting, gluing, wrapping around, chemical or mechanical bonds, or otherwise joined together while at least partially retaining their respective individual fiber characteristics.

"Fiber length ratio" is the ratio of length weighted average fiber lengths of the different fiber types measured by the method set forth in TAPPI T 271 om-02, paragraph 8.2 related to length weighted average fiber length ($L_L$) measured using Kajaani FiberLab equipment, as described in the examples, below.

"Long cellulosic fibers" or "long cellulose fibers" are fibers that are generally from softwood sources and have a length in the longest dimension of greater than about 2 mm, when measured in a flat and straight configuration. Non-limiting examples of long cellulose fibers may be obtained from pine, spruce, fir and cedar wood trees.

"PTP factor" is the ratio of the average synthetic fiber diameter to the average cellulosic fiber width, as described in more detail in the examples, below. Without wishing to be bound by theory, the PTP factor is thought to be related to the tendency to form functional bonds between synthetic fibers and cellulosic fibers. This advantageous bonding tendency may result from a more uniform distribution of synthetic fibers in the mixture of synthetic fibers and short cellulosic fibers.

"Redistribution" means at least some of the plurality of fibers comprised in the unitary fibrous structure of the present invention at least partially melt, move, shrink, and/or otherwise change their initial position, condition, and/or shape in the web.

"Short cellulosic fibers" or "short cellulose fibers" are fibers that typically come from hardwoods and have a length in the longest dimension of less than about 2 mm, when measured in a flat and straight configuration. In certain examples, the short cellulosic fibers may have a length of less than about 1 mm. Non-limiting examples of short cellulose fibers may be obtained from eucalyptus, acacia and maple trees.

"Unitary fibrous structure" is an arrangement comprising a plurality of cellulosic fibers and synthetic fibers that are inter-entangled or otherwise joined to form a sheet product having certain pre-determined microscopic geometric, physical, and aesthetic properties. The cellulosic and/or synthetic fibers may be layered or otherwise arranged in the unitary fibrous structure.

The fibrous structure of the present invention may take on a number of different forms, but in general, includes at least one layer having synthetic fibers mixed with cellulosic fibers and at least one adjacent layer that comprises cellulosic fibers. More specifically, in one embodiment of the present invention, the fibrous structure may include one or more layers including synthetic fibers mixed with short cellulosic fibers, as described herein. The synthetic fiber/short cellulosic fiber mix may be relatively homogeneous, in that the different fibers are dispersed generally randomly and throughout the layer, or may be more structured such that the synthetic fibers and/or the cellulosic fibers are disposed generally non-randomly. Further, one or more of the layers of mixed cellulosic fibers and synthetic fibers may be formed or subjected to some type of manipulation during or after the web is made to provide the layer or layers of mixed synthetic and cellulosic fibers in a predetermined pattern or other non-random pattern.

The fibrous structure may include different fiber types. For example, the structure may include naturally occurring fibers, such as fibers from hardwood sources, softwood sources or other non-wood plants. Non-limiting examples of suitable natural fibers are identified in TABLE 1. Other sources of natural fibers from plants include, but are not limited to albardine, esparto, wheat, rice, corn, sugar cane, papyrus, jute, reed, sabia, raphia, bamboo, sidal, kenaf, abaca, sunn, cotton, hemp, flax and ramie. Yet other natural fibers may also include fibers from other natural non-plant sources, such as down, feathers, silk and the like. The natural fibers may be treated or otherwise modified mechanically or chemically to provide desired characteristics or may be in a form that is generally similar to the form they can be found in nature. Mechanical and/or chemical manipulation of natural fibers does not exclude them from what are considered natural fibers with respect to the development described herein.

TABLE 1

| | Length weighted Ave. Fiber length, mm | Average fiber width, μm | Coarseness mg/100 m |
|---|---|---|---|
| Typical Northern Softwood Kraft | 1.98-2.14 | 24.6-26.7 | 17.3-19.6 |
| Typical Southern Softwood Kraft | 2.29-2.86 | 27.7-28.9 | 23.2-28.9 |

TABLE 1-continued

| | Length weighted Ave. Fiber length, mm | Average fiber width, μm | Coarseness mg/100 m |
|---|---|---|---|
| Typical CTMP | 2.24 | 34.2 | 35.4 |
| Typical Deinked | 0.84-0.90 | 17.2-17.8 | 13.3-13.4 |
| Corn pulp | 0.47-0.73 | 17.7-18.9 | 10.4-12.4 |
| Acacia | 0.65-0.67 | 14.1-14.3 | 6.5-6.6 |
| Eucalyptus | 0.70-0.74 | 14.6-14.9 | 8.2-8.7 |
| Aspen | 0.77 | 19.2 | 10.3 |
| Reed pulp | 0.77 | 17.3 | 12.8 |
| Birch | 1.04 | 19.1 | 12.9 |
| Maple | 0.52 | 14.0 | 6.9 |
| Radiata Pine | 2.10-2.20 | 27.7-28.1 | 23.7-27.2 |

The fibrous structure may also include any suitable synthetic fibers. The synthetic fibers can be any material, for example, those selected from the group consisting of polyolefins, polyesters, polyamides, polyhydroxyalkanoates, polysaccharides, and any combination thereof. More specifically, the material of the synthetic fibers can be selected from the group consisting of polypropylene, polyethylene, poly(ethylene terephthalate), poly(butylene terephthalate), poly(1,4-cyclohexylenedimethylene terephthalate), isophthalic acid copolymers, ethylene glycol copolymers, polycaprolactone, poly(hydroxy ether ester), poly(hydroxy ether amide), polyesteramide, poly(lactic acid), polyhydroxybutyrate, starch, cellulose, glycogen and any combination thereof. Further, the synthetic fibers can be single component (i.e. single synthetic material or mixture makes up entire fiber), bi-component (i.e. the fiber is divided into regions, the regions including two different synthetic materials or mixtures thereof) or multi-component fibers (i.e. the fiber is divided into regions, the regions including two or more different synthetic materials or mixtures thereof) or any combination thereof. Also, any or all of the synthetic fibers may be treated before, during or after the process of the present invention to change any desired property of the fibers. For example, in certain embodiments, it may be desirable to treat the synthetic fibers before or during the papermaking process to make them more hydrophilic, more wettable, etc.

In certain embodiments of the present invention, it may be desirable to have particular combinations of fibers to provide desired characteristics. For example, it may be desirable to have fibers of certain lengths, widths, coarseness or other characteristics combined in certain layers or separate from each other. Individually, the fibers may have certain desired characteristics. For example, the long cellulosic fibers can have any desired characteristics that are consistent with the definition set forth above. In certain embodiments, it may be desirable for the long cellulosic fibers to have an average cellulosic fiber width of less than about 50 micrometers, less than about 40 micrometers, less than about 30 micrometers, less than about 25 micrometers; or have an average cellulosic fiber width that falls within a range of about 10 to about 50 micrometers. Further, it may be desirable that the short cellulosic fibers have an average cellulosic fiber width of less than about 25 micrometers, less than about 20 micrometers, less than about 18 micrometers; or have an average cellulosic fiber width that falls within a range of about 8 to about 25 micrometers. With regard to the synthetic fibers, it may be desirable that they have certain characteristics such as, for example, an average fiber diameter of more than about 10 micrometers, more than about 15 micrometers, more than about 25 micrometers, more than about 30 micrometers; or have an average synthetic fiber diameter that falls within a range of about 10 to about 50 micrometers.

It may also be desirable to mix fibers in one or more layers such that the particular fibers in one or more layers have a fiber length ratio, or a PTP factor, as defined herein, with respect to each other in a particular range. In certain embodiments, the fiber length ratio of the synthetic fibers 101 to the short cellulosic fibers 102 in the mixed layer(s) 105 is greater than about 1, greater than about 1.25, greater that about 1.5 or greater than about 2; although other minimum limitations for the fiber length ratio are contemplated as are ranges that extend from about 1 to about 20 with any upper or lower limit within the range. In certain embodiments, it may also be desirable for the mixed layer(s) 105 to have a PTP factor of greater than about 0.75, greater than about 1, greater than about 1.25, greater that about 1.5 or greater than about 2; although other minimum limitations for the PTP factor are contemplated as are ranges that extend from about 0.75 to about 10 with any upper or lower limit within the range. It may also be desirable for the mixed layer(s) to have a coarseness value of less than about 50 mg/100 m, less than about 40 mg/100 m, less than about 30 mg/100 m or less than about 25 mg/100 m; although other maximum limitations for the coarseness are contemplated as are ranges that extend from about 5 mg/100 m to about 75 mg/100 m.

As can be seen in the Examples, below, the invention provides a web and a method for forming a web that has surprising characteristics. For example, the fibrous structures of the present invention may provide, individually, or in combination benefits over currently available webs in the areas of, for example, softness, better an/or more uniform formation and wet burst, and can provide manufacturing benefits by increasing output rates due to a reduced need to refine cellulosic fibers to get the same properties in the resulting web.

As described in Example 1, a two ply paper web is made including NSK and Eucalyptus fibers. The resulting web has a wet burst strength of about 374 g. In Example 2, a two ply paper web is made in the same way as the web of Example 1, but it replaces 10% by weight of the Eucalyptus fibers with 10% by weight synthetic bicomponent polyester fibers (3 mm length). The synthetic/Eucalyptus mixture has a fiber length ratio of 4.2, a PTP factor of 1.2 and a coarseness value of 11.0 mg/100 m. The resulting fibrous structure of Example 2 has a wet burst strength of about 484 g, which is higher than the wet burst strength of the typical product made in Example 1. In Example 3, a two ply paper web is made in the same way as the web of Example 1, but it replaces 5% by weight of the Eucalyptus fibers with 5% by weight synthetic bicomponent polyester fibers (6 mm length). The synthetic/Eucalyptus mixture has a fiber length ratio of 8.4, a PTP factor of 1.2 and a coarseness value of 11.6 mg/100 m. The resulting fibrous structure of Example 3, with even fewer synthetic fibers by weight has a wet burst strength of about 472 g, which is still much higher than the wet burst strength of the product of Example 1. Accordingly, it can be seen that structure of the present invention and the method of making the structure provide surprising means for enhancing the wet burst of a web with the use of a small percent by weight of synthetic fibers in mixture with short cellulosic fibers. Of course, these examples should not be considered to be the only examples of the invention's benefits and it should be understood other embodiments are contemplated and that such other embodiments based on the teaching herein, could easily be made by those skilled in the art. Further, any such additional or modified examples are considered within the scope of the present invention even if the particular benefit or property is not described in detail, herein.

Figure 9:
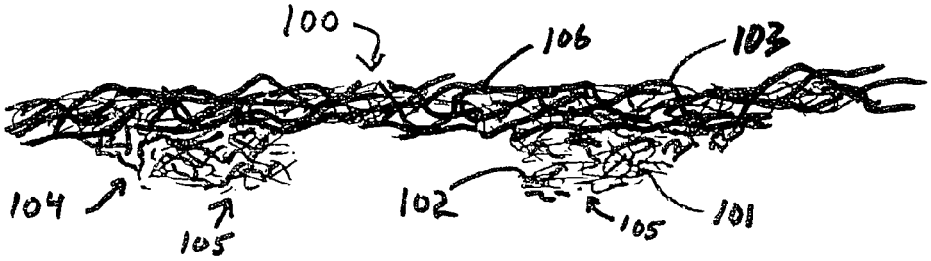
FIG. 9 is a cross-sectional view of a unitary fibrous structure of the present invention, wherein the cellulosic fibers are distributed generally randomly and the synthetic fibers are distributed generally non-randomly.
Figure 9A:
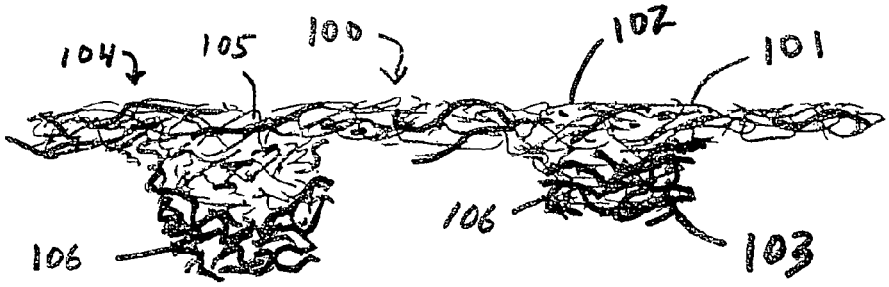
FIG. 9A is a cross-sectional view of a unitary fibrous structure of the present invention, wherein the synthetic fibers are distributed generally randomly and the cellulosic fibers are distributed generally non-randomly.

Generally, the process of the present invention for making a fibrous structure 100 will be described in terms of forming a web having a plurality of synthetic fibers 101 mixed with a plurality of short cellulosic fibers 102 and disposed in one or more layers. The structure will generally also include one or more layers that include longer fibers, typically long cellulosic fibers 103. In one embodiment, the mixed layer 105 including synthetic fibers 101 and short cellulosic fibers 102 may be formed such that it is at least partially disposed in a generally non-random pattern. Typically, the layer(s) 106 of longer fibers 103 will be disposed generally randomly (e.g. as shown in FIG. 9), although such layer(s) 106 may be patterned or otherwise disposed non-randomly. The method and apparatus of the present invention are also suitable for forming a web having a plurality of long cellulosic fibers 103 disposed in a generally non-random pattern and a plurality of synthetic fibers 101 and short cellulosic fibers 102 mixed together and disposed generally randomly (e.g. as shown in FIG. 9A) in a layer 105.

In embodiments wherein the mixture 104 of synthetic fibers 101 and short cellulosic fibers 102 is disposed non-randomly, the method may include the steps of providing a mixture of synthetic fibers 101 and short cellulosic fibers 102 onto a forming member such that the mixture 104 of synthetic fibers 101 and short cellulosic fibers 102 is located at least partially in predetermined regions or channels, providing a plurality of longer cellulosic fibers 103 generally randomly onto the mixture 104 of synthetic and short cellulosic fibers 102 and forming a unitary fibrous structure including the randomly disposed cellulosic fibers and the non-randomly disposed synthetic fiber/short cellulosic fiber mixture 104.

In embodiments wherein the mixture 104 of synthetic fibers 101 and short cellulosic fibers 102 is disposed generally randomly and the longer cellulosic fibers 103 are disposed non-randomly, the method may include the steps of providing a plurality of long cellulosic fibers onto a forming member such that the long cellulosic fibers 103 are located at least partially in predetermined regions or channels in the forming member, providing a mixture of shorter cellulosic fibers 102 and synthetic fibers 101 randomly onto the long cellulosic fibers 103 and forming a unitary fibrous structure including the non-randomly disposed long cellulosic fibers 103 and randomly disposed synthetic fiber/short cellulosic fiber mixture 104.

Figure 7:
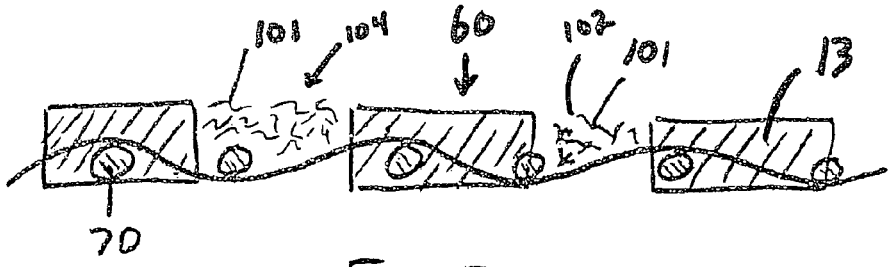
FIG. 7 is a schematic cross-sectional view showing exemplary synthetic fibers distributed in the channels formed in the forming member.
Figure 8:
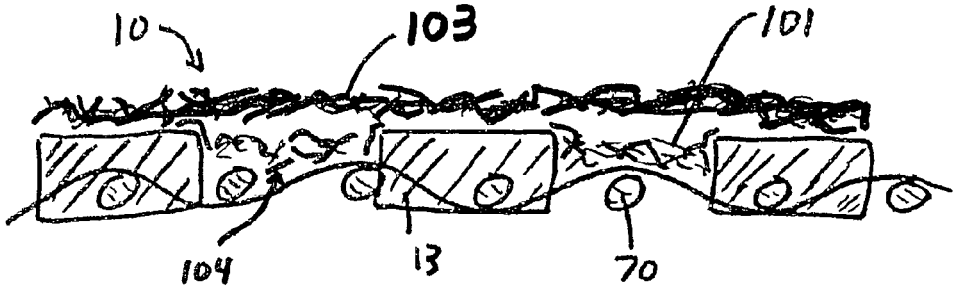
FIG. 8 is a cross-sectional view showing a unitary fibrous structure of the present invention, wherein the cellulosic fibers are randomly distributed on the forming member including the synthetic fibers.

FIG. 1 shows one exemplary embodiment of a continuous process of the present invention in which an aqueous slurry 11 of fibers is deposited on a forming member 13 from headbox 12 to form an embryonic web 10. (However, this is only one of any number of methods that could be used to for the web of the present invention, including similar methods with additional or fewer steps, or different methods such as air laying and the like. Further, the method of the present invention may include a combination of one or more of these or other known methods for making webs.) In this particular embodiment, the forming member 13 is supported by and continuously traveling around rolls 13*a*, 13*b*, and 13*c* in a direction of the arrow A. The slurry 11 may include any number of different fiber types and may be deposited in layers. In one embodiment, the slurry 11 includes at least one layer comprising a mixture 104 of synthetic fibers 101 and short cellulosic fibers 102, as described herein. In addition, the slurry 11 may also include one or more layers of long cellulosic fibers 103, as described herein. If it is desired that the mixture 104 of short cellulosic fibers 102 and synthetic fibers 101 be formed into a non-random pattern, the mixture 104 may be deposited onto the forming member 13 prior to the deposition of the long cellulosic fibers 103 such that at least some of the mixture 104 is directed into predetermined regions, such as channels 53 present in forming member 13 (e.g. as shown in FIGS. 7-8). In certain embodiments, more than one headbox 12 can be employed and/or the mixture 104 may be deposited onto a forming member 13 and then transferred to a different forming member where the long cellulosic fibers 103 are then deposited onto the mixture 104.

In one embodiment of the present invention, the mixture 104 of synthetic fibers 101 and short cellulosic fibers 102 is provided such that at least the synthetic fibers 104 are predominantly disposed in the channels 53 of the forming member 13. That is, more than half of the synthetic fibers 101 are disposed in the channels 53 when the web 10 is being formed. In certain embodiments, it may be desirable for at least about 60%, about 75%, about 80% or substantially all of the synthetic fibers 101 to be disposed in the channels 53 when the web 10 is being formed. In addition, it may be desired that the resulting product, web 100, includes a certain percentage of synthetic fibers 101 disposed in one or more layers. For example, it may be desirable that the layer formed by fibers deposited first or closest to the forming member 13 have a concentration of greater than about 50%, greater than about 60% or greater than about 75% synthetic fibers 101. Alternatively, it may be desirable to have such layers include most, all or a certain percentage of a mixture 104 of synthetic fibers 101 and short cellulosic fibers 102. (A suitable method for measuring the percentage of a particular type of fiber in a layer of a web product is disclosed in U.S. Pat. No. 5,178,729 issued to Bruce Janda on Jan. 12, 1993.) Further, in certain embodiments, it may be desired that the long cellulosic fibers 103 be provided so as to be disposed predominantly in at least one layer adjacent the mixture 104 of synthetic fibers 101 and short cellulosic fibers 102. In other embodiments, it may be desired that at least a certain percentage of the long cellulosic fibers 103 are disposed in at least one layer of the web 100, such as for example, greater than about 55%, greater than about 60% or greater than about 75%. Typically, at least one layer of the long cellulosic fibers 103 will be disposed generally randomly. Thus, the resulting web 100 can be provided with a non-random pattern of synthetic fibers 101 and/or a mixture 104 of synthetic fibers 101 and short cellulosic fibers 102 joined to one or more layers of generally randomly distributed long cellulosic fibers 103 (e.g. FIGS. 9 and 10). Further, a fibrous structure can be formed that has micro-regions of different basis weight.

Figure 2:
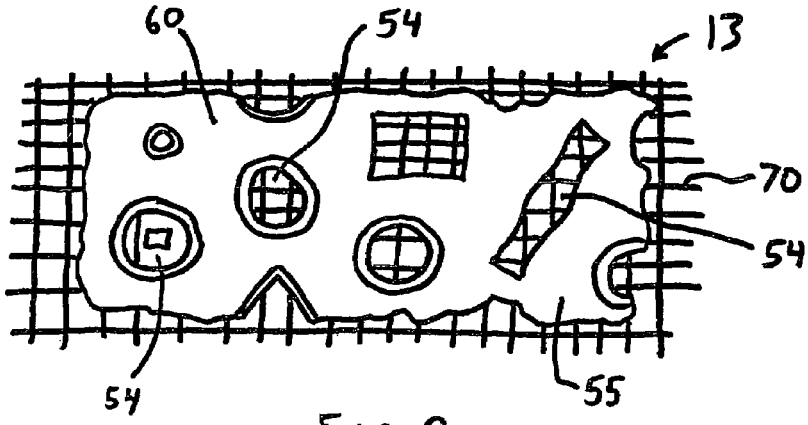
FIG. 2 is a schematic plan view of an embodiment of a forming member having a substantially continuous framework.
Figure 3:
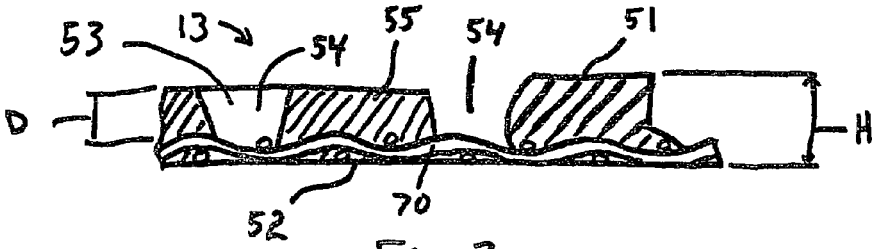
FIG. 3 is a representational cross-sectional view of an exemplary forming member.
Figure 4:
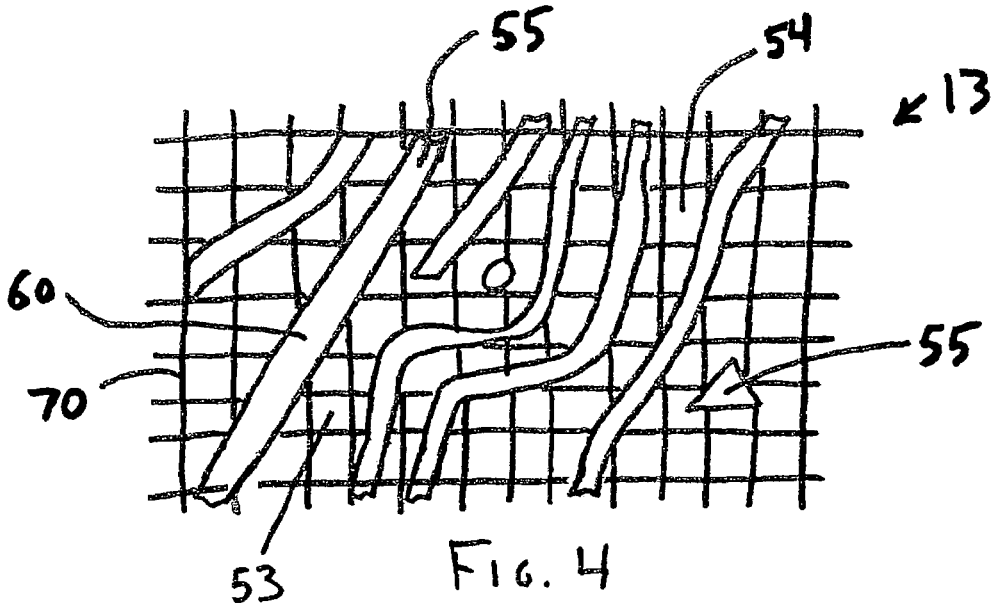
FIG. 4 is a schematic plan view of an embodiment of a forming member having a substantially semi-continuous framework.

The forming member 13 may be any suitable structure and is typically at least partially fluid-permeable. For example, the forming member 13 may comprise a plurality of fluid-permeable areas 54 and a plurality of fluid-impermeable areas 55, as shown, for example in FIGS. 2-6. The fluid-permeable areas or apertures 54 may extend through a thickness H of the forming member 13, from the web-side 51 to the backside 52. In certain embodiments, some of the fluid-permeable areas 54 comprising apertures may be "blind," or "closed", as described in U.S. Pat. No. 5,972,813, issued to Polat et al. on Oct. 26, 1999. The fluid permeable areas 54, whether open, blind or closed form channels 53 into which fibers can be directed. At least one of the plurality of fluid-permeable areas 54 and the plurality of fluid-impermeable areas 55 typically forms a pattern throughout the molding member 50. Such a pattern can comprise a random pattern or a non-random pattern and can be substantially continuous (e.g. FIG. 2), substantially semi-continuous (e.g. FIG. 4), discrete (e.g. FIG. 5) or any combination thereof.

The forming member 13 may have any suitable thickness H and, in fact, the thickness H can be made to vary throughout the forming member 13, as desired. Further, the channels 53 may be any shape or combination of different shapes and may have any depth D, which can vary throughout the forming member 13. Also, the channels 53 can have any desired volume. The depth D and volume of the channels 53 can be varied, as desired, to help ensure the desired concentration of synthetic fibers 101 and/or short cellulosic fibers 102 in the channels 53. In certain embodiments, it may be desirable for the depth D of the channels 53 to be less than about 254 micrometers or less than about 127 micrometers. Further, the amount of synthetic fibers 101 and/or short cellulosic fibers 102 deposited onto the forming member 13 can be varied so as to ensure the desired ratio or percentage of synthetic fibers 101 and/or short cellulosic fibers 102 are disposed in the channels 53 of a particular depth D or volume. For example, in certain embodiments, it may be desirable to provide enough synthetic fibers 101 or a mixture 104 of synthetic fibers 101 and short cellulosic fibers 102 to substantially fill channels 53 such that virtually no long cellulosic fibers 103 will be located in the channels 53 during the web making process. In other embodiments, it may be desirable to provide only enough synthetic fibers 101 and/or short cellulosic fibers 102 to fill a portion of the channels 53 such that at least some long cellulosic fibers 103 can also be directed into the channels 53.

Figure 5:
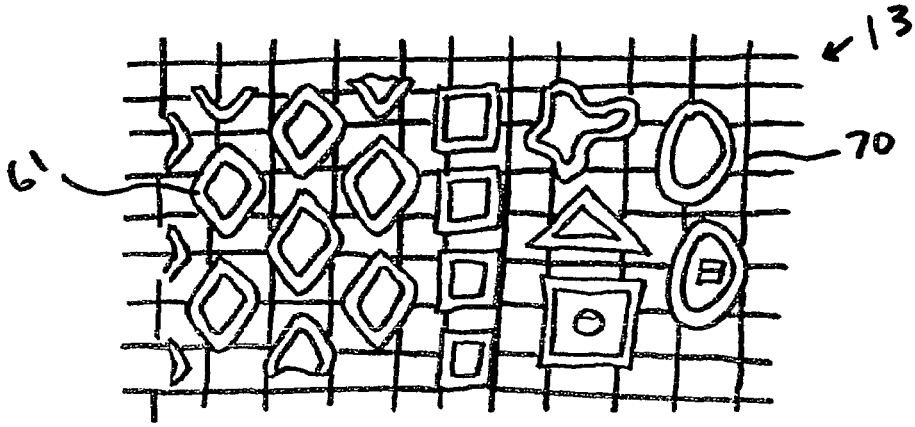
FIG. 5 is a schematic plan view of an embodiment of a forming member having a discrete pattern framework.
Figure 6:
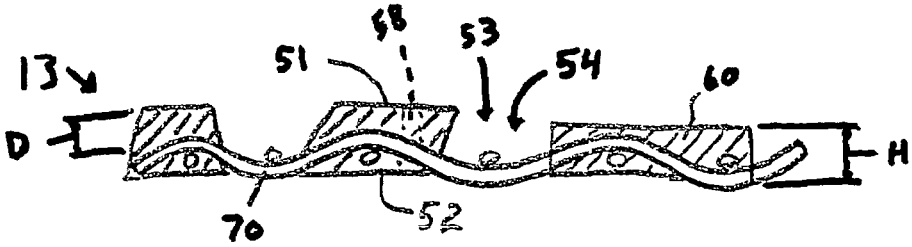
FIG. 6 is a representational cross-sectional view of an exemplary forming member.

Some exemplary forming members 13 may comprise structures as shown in FIGS. 2-8 including a fluid-permeable reinforcing element 70 and a pattern or framework 60 extending there from to form a plurality of channels 53. In one embodiment, as shown in FIGS. 5 and 6, the forming member 13 may comprise a plurality of discrete protuberances 61 joined to or integral with a reinforcing element 70. The reinforcing element 70 generally serves to provide or facilitate integrity, stability, and durability. The reinforcing element 70 can be fluid-permeable or partially fluid-permeable, may have a variety of embodiments and weave patterns, and may comprise a variety of materials, such as, for example, a plurality of interwoven yarns (including Jacquard-type and the like woven patterns), a felt, a plastic or other synthetic material, a net, a plate having a plurality of holes, or any combination thereof. Examples of suitable reinforcing elements 70 are described in U.S. Pat. No. 5,496,624, issued Mar. 5, 1996 to Stelljes, et al., U.S. Pat. No. 5,500,277 issued Mar. 19, 1996 to Trokhan et al., and U.S. Pat. No. 5,566,724 issued Oct. 22, 1996 to Trokhan et al. Alternatively, a reinforcing element 70 comprising a Jacquard-type weave, or the like, can be utilized. Illustrative belts can be found in U.S. Pat. No. 5,429,686 issued Jul. 4, 1995 to Chiu, et al.; U.S. Pat. No. 5,672,248 issued Sept. 30, 1997 to Wendt, et al.; U.S. Pat. No. 5,746,887 issued May 5, 1998 to wendt, et al.; and U.S. Pat. No. 6,017,417 issued Jan. 25, 2000 to Wendt, et al. Further, various designs of the Jacquard-weave pattern may be utilized as a forming member 13.

Exemplary suitable framework elements 60 and methods for applying the framework 60 to the reinforcing element 70, are taught, for example, by U.S. Pat. No. 4,514,345 issued Apr. 30, 1985 to Johnson; U.S. Pat. No. 4,528,239 issued Jul. 9, 1985 to Trokhan; U.S. Pat. No. 4,529,480 issued Jul. 16, 1985 Trokhan; U.S. Pat. No. 4,637,859 issued Jan. 20, 1987 to Trokhan; U.S. Pat. No. 5,334,289 issued Aug. 2, 1994 Trokhan; U.S. Pat. No. 5,500,277 issued Mar. 19, 1996 to Trokhan et al.; U.S. Pat. No. 5,514,523 issued May 7, 1996 to Trokhan et al.; U.S. Pat. No. 5,628,876 issued May 13, 1997 to Ayers et al.; U.S. Pat. No. 5,804,036 issued Sep. 8, 1998 to Phan et al.; U.S. Pat. No. 5,906,710 issued May 25, 1999 to Trokhan; U.S. Pat. No. 6,039,839 issued Mar. 21, 2000 to Trokhan et al.; U.S. Pat. No. 6,110,324 issued Aug. 29, 2000 to Trokhan et al.; U.S. Pat. No. 6,117,270 issued Sep. 12, 2000 to Trokhan; U.S. Pat. No. 6,171,447 B1 issued Jan. 9, 2001 to Trokhan; and U.S. Pat. No. 6,193,847 B1 issued Feb. 27, 2001 to Trokhan. Further, as shown in FIG. 6, framework 60 may include one or apertures or holes 58 extending through the framework element 60. Such holes 58 are different from the channels 53 and may be used to help dewater the slurry or web and/or aid in keeping fibers deposited on the framework 60 from moving completely into the channels 53.

Alternatively, the forming member 13 may include any other structure suitable for receiving fibers and including some pattern of channels 53 into which the synthetic fibers 101 and/or short cellulosic fibers 102 may be directed, including, but not limited to, wires, composite belts and/or felts. In any case, the pattern or framework 60 may be discrete, as noted above, or substantially discrete, may be continuous or substantially continuous or may be semi-continuous or substantially semi-continuous. Certain exemplary forming members 13 generally suitable for use with the method of the present invention include the forming members described in U.S. Pat. Nos. 5,245,025; 5,277,761; 5,443,691; 5,503,715; 5,527,428; 5,534,326; 5,614,061 and 5,654,076.

If the forming member 13 includes a press felt, it may be made according to the teachings of U.S. Pat. No. 5,580,423, issued Dec. 3, 1996 to Ampulski et al.; U.S. Pat. No. 5,609,725, issued Mar. 11, 1997 to Phan; U.S. Pat. No. 5,629,052 issued May 13, 1997 to Trokhan et al.; U.S. Pat. No. 5,637,194, issued Jun. 10, 1997 to Ampulski et al.; U.S. Pat. No. 5,674,663, issued Oct. 7, 1997 to McFarland et al.; U.S. Pat. No. 5,693,187 issued Dec. 2, 1997 to Ampulski et al.; U.S. Pat. No. 5,709,775 issued Jan. 20, 1998 to Trokhan et al.; U.S. Pat. No. 5,776,307 issued Jul. 7, 1998 to Ampulski et al.; U.S. Pat. No. 5,795,440 issued Aug. 18, 1998 to Ampulski et al.; U.S. Pat. No. 5,814,190 issued Sep. 29, 1998 to Phan; U.S. Pat. No. 5,817,377 issued Oct. 6, 1998 to Trokhan et al.; U.S. Pat. No. 5,846,379 issued Dec. 8, 1998 to Ampulski et al.; U.S. Pat. No. 5,855,739 issued Jan. 5, 1999 to Ampulski et al.; and U.S. Pat. No. 5,861,082 issue Jan. 19, 1999 to Ampulski et al. In an alternative embodiment, the forming member 13 may be executed as a press felt according to the teachings of U.S. Pat. No. 5,569,358 issued Oct. 29, 1996 to Cameron or any other suitable structure. Other structures suitable for use as forming members 13 are hereinafter described with respect to the optional molding member 50.

A vacuum apparatus such as vacuum apparatus 14 located under the forming member 13 may be used to apply fluid pressure differential to the slurry disposed on the forming member 13 to facilitate at least partial dewatering of the embryonic web 10. This fluid pressure differential can also help direct the desired fibers, e.g. the mixture 104 of synthetic fibers 101 and short cellulosic fibers 102 into the channels 53 of the forming member 13. Other known methods may be used in addition to or as an alternative to the vacuum apparatus 14 to dewater the web 10 and/or to help direct the fibers into the channels 53 of the forming member 13.

If desired, the embryonic web 10, formed on the forming member 13, can be transferred from the forming member 13, to a felt or other structure such as a molding member. A molding member is a structural element that can be used as a support for the an embryonic web, as well as a forming unit to form, or "mold," a desired microscopical geometry of the fibrous structure. The molding member may comprise any element that has the ability to impart a microscopical three-dimensional pattern to the structure being produced thereon, and includes, without limitation, single-layer and multi-layer structures comprising a stationary plate, a belt, a woven fabric (including Jacquard-type and the like woven patterns), a band, and a roll.

In the exemplary embodiment shown in FIG. 1, the molding member 50 is fluid permeable and vacuum shoe 15 applies vacuum pressure that is sufficient to cause the embryonic web 10 disposed on the forming member 13 to separate there from and adhere to the molding member 50. The molding member 50 of FIG. 1 comprises a belt supported by and traveling around rolls 50*a*, 50*b*, 50*c*, and 50*d* in the direction of the arrow B. The molding member 50 has a web-contacting side 151 and a backside 152 opposite to the web-contacting side 151.

The molding member 50 can take on any suitable form and can be made of any suitable materials. The molding member 50 may include any structure and be made by any of the methods described herein with respect to the forming member 13, although the molding member 50 is not limited to such structures or methods. For example, the molding member 50 comprises a resinous framework 160 joined to a reinforcing element 170, as shown, for example in FIGS. 13-14. Further, various designs of Jacquard-weave patterns may be utilized as the molding member 50, and/or a pressing surface 210. If desired, the molding member 50 may be or include a press felt. Suitable press felts for use with the present invention include, but are not limited to those described herein with respect to the forming member 13

Figure 13:
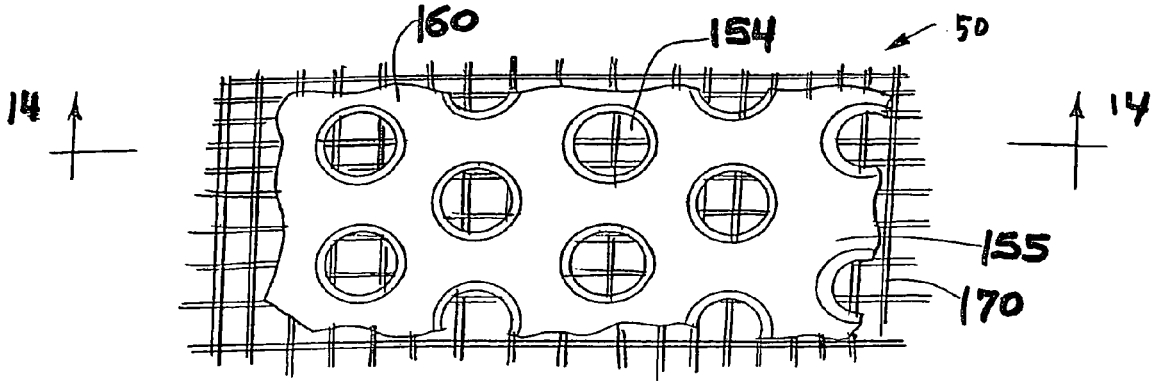
FIG. 13 is a schematic plan view of an embodiment of a molding member having a substantially continuous pattern framework.
Figure 14:
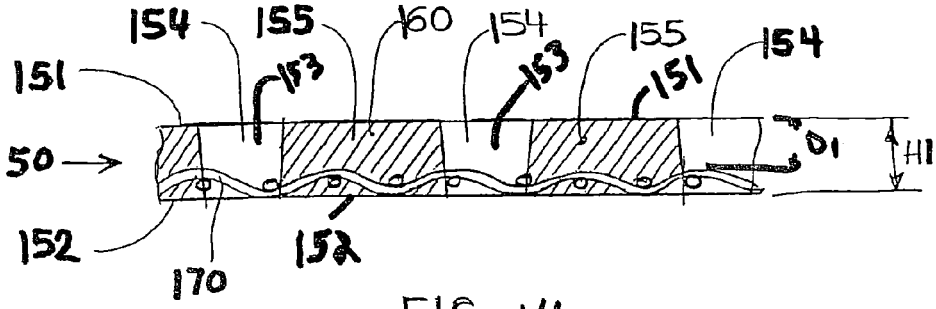
FIG. 14 is a schematic cross-sectional view taken along line 14-14 of FIG. 13.
Figure 15:
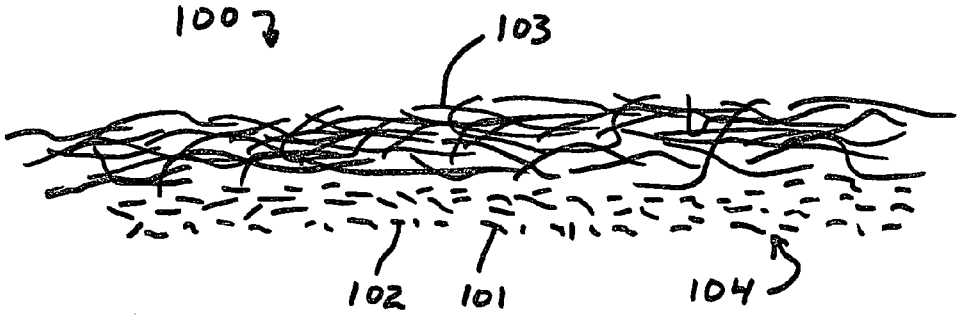
FIG. 15 is a cross-sectional view of a unitary fibrous structure, wherein synthetic fibers and short cellulosic fibers are disposed in one layer and long cellulosic fibers are disposed in an adjacent layer.

In certain embodiments, the molding member 50 may comprise a plurality of fluid-permeable areas 154 and a plurality of fluid-impermeable areas 155, as shown, for example in FIGS. 13 and 14. The fluid-permeable areas or apertures 154 extend through a thickness H1 of the molding member 50, from the web-side 151 to the backside 152. As noted above with respect to the forming member 13, the thickness H1 of the molding member can be any desired thickness. Further, the depth D1 and volume of the channels 153 can vary, as desired. Further, one or more of the fluid-permeable areas 154 comprising apertures may be "blind," or "closed", as described above with respect to the forming member 13. At least one of the plurality of fluid-permeable areas 154 and the plurality of fluid-impermeable areas 155 typically forms a pattern throughout the molding member 50. Such a pattern can comprise a random pattern or a non-random pattern and can be substantially continuous, substantially semi-continuous, discrete or any combination thereof. The portions of the reinforcing element 170 registered with apertures 154 in the molding member 50 may provide support for fibers that are deflected into the fluid-permeable areas of the molding member 50 during the process of making the unitary fibrous structure 100. The reinforcing element can help prevent the fibers of the web being made from passing through the molding member 50, thereby reducing occurrences of pinholes in the resulting structure 100. In other embodiments, the molding member 50 may comprise a plurality of suspended portions extending from a plurality of base portions, as is taught by U.S. Pat. No. 6,576,090 issued Jun. 10, 2003 to Trokhan et al.

When the embryonic web 10 is disposed on the web-contacting side 151 of the molding member 50, the web 10 preferably at least partially conforms to the three-dimensional pattern of the molding member 50. In addition, various means can be utilized to cause or encourage the cellulosic and/or synthetic fibers of the embryonic web 10 to conform to the three-dimensional pattern of the molding member 50 and to become a molded web designated as "20" in FIG. 1. (It is to be understood, that the referral numerals "10" and "20" can be used herein interchangeably, as well as the terms "embryonic web" and "molded web"). One method includes applying a fluid pressure differential to the plurality of fibers. For example, as shown in FIG. 1, vacuum apparatuses 16 and/or 17 disposed at the backside 152 of the molding member 50 can be arranged to apply a vacuum pressure to the molding member 50 and thus to the plurality of fibers disposed thereon. Under the influence of fluid pressure differential $\Delta P1$ and/or $\Delta P2$ created by the vacuum pressure of the vacuum apparatuses 16 and 17, respectively, portions of the embryonic web 10 can be deflected into the channels 153 of the molding member 50 and conform to the three-dimensional pattern thereof.

Figure 11:
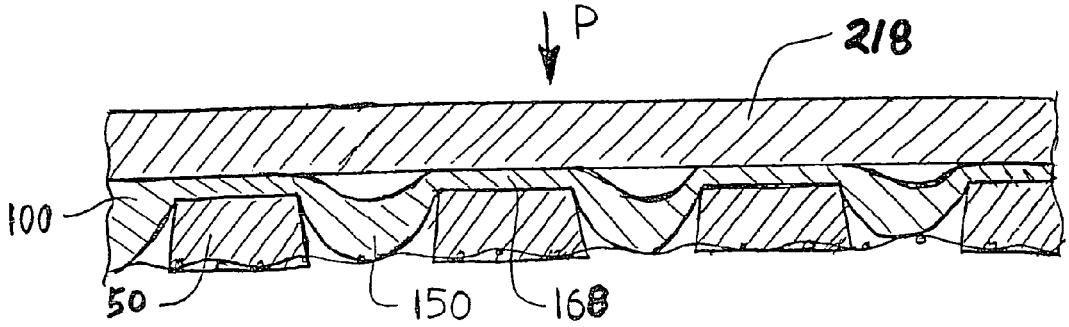
FIG. 11 is a schematic cross-sectional view of a unitary fibrous structure of the present invention between a pressing surface and a molding member.

By deflecting portions of the embryonic web 10 into the channels 153 of the molding member 50, one can decrease the density of resulting pillows 150 formed in the channels 153 of the molding member 50, relative to the density of the rest of the molded web 20. Regions 168 that are not deflected into the apertures may later be imprinted by impressing the web 20 between a pressing surface 218 and the molding member 50 (FIG. 11), such as, for example, in a compression nip formed between a surface 210 of a drying drum 200 and the roll 50*c*, shown in FIG. 1. If imprinted, the density of the regions 168 may increase even more relative to the density of the pillows 150. The plurality of pillows 150 may comprise symmetrical pillows, asymmetrical pillows, or a combination thereof.

Differential elevations of the micro-regions can also be formed by using the molding member 50 having differential depths or elevations of its three-dimensional pattern. Such three-dimensional patterns having differential depths/elevations can be made by sanding pre-selected portions of the molding member 50 to reduce their elevation. Alternatively, a three-dimensional mask comprising differential depths/elevations of its depressions/protrusions, can be used to form a corresponding framework 160 having differential elevations. Other conventional techniques of forming surfaces with differential elevation can also be used for the foregoing purposes. It should be recognized that the techniques described herein for forming the molding member are also applicable to the formation of the forming member 13.

In certain embodiments, it may be desirable to foreshorten the fibrous structure 100 of the present invention as it is being formed. For example, the molding member 50 may be configured to have a linear velocity that is less that that of the forming member 13. The use of such a velocity differential at the transfer point from the forming member 13 to the molding member 50 can be used to achieve "microcontraction". U.S. Pat. No. 4,440,597 describes in detail one example of wet-microcontraction. Such wet-microcontraction may involve transferring the web having a low fiber-consistency from any first member (such as, for example, a foraminous forming member) to any second member (such as, for example, an open-weave fabric) moving slower than the first member. The difference in velocity between the first member and the second member can vary depending on the desired end characteristics of the fibrous structure 100. Other patents that describe methods for achieving microcontraction include, for example, U.S. Pat. Nos. 5,830,321; 6,361,654 and 6,171,442.

The fibrous structure 100 may additionally or alternatively be foreshortened after it has been formed and/or substantially dried. For example, foreshortening can be accomplished by creping the structure 100 from a rigid surface, such as, for example, a surface 210 of a drying drum 200, as shown in FIG. 1. This and other forms of creping are known in the art. U.S. Pat. No. 4,919,756, issued Apr. 24, 1992 to Sawdai describes one suitable method for creping a web. Of course, fibrous structures 100 that are not creped (e.g. uncreped) and/or otherwise foreshortened are contemplated to be within the scope of the present invention as are fibrous structures 100 that are not creped, but are otherwise foreshortened.

Figure 12:
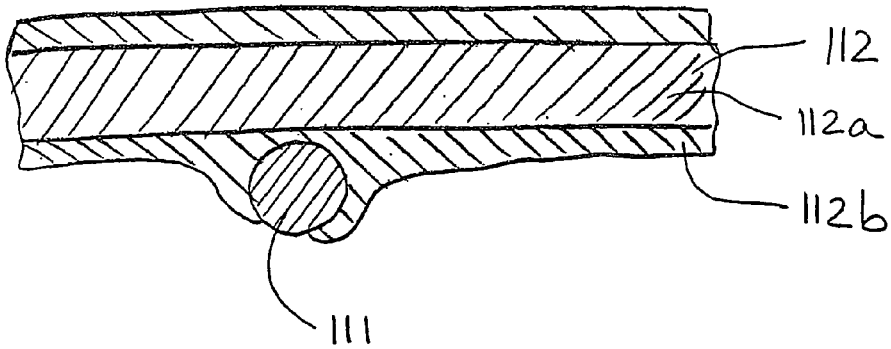
FIG. 12 is a schematic cross-sectional view of a bi-component synthetic fiber co-joined with another fiber.

In certain embodiments, it may be desirable to at least partially melt or soften at least some of the synthetic fibers 101. As the synthetic fibers at least partially melt or soften, they may become capable of co-joining with adjacent fibers, whether short cellulosic fibers 102, long cellulosic fibers 103 or other synthetic fibers 101. Co-joining of fibers can comprise mechanical co-joining and chemical co-joining. Chemical co-joining occurs when at least two adjacent fibers join together on a molecular level such that the identity of the individual co-joined fibers is substantially lost in the co-joined area. Mechanical co-joining of fibers takes place when one fiber merely conforms to the shape of the adjacent fiber, and there is no chemical reaction between the co-joined fibers. FIG. 12 shows one embodiment of mechanical co-joining, wherein a fiber 111 is physically entrapped by an adjacent synthetic fiber 112. The fiber 111 can be a synthetic fiber or a cellulosic fiber. In the example shown in FIG. 12, the synthetic fiber 112 has a bi-component structure, comprising a core 112*a* and a sheath, or shell, 112*b*, wherein the melting temperature of the core 112*a* is greater than the melting temperature of the sheath 112*b*, so that when heated, only the sheath 112*b* melts, while the core 112*a* retains its integrity. However, it is to be understood that different types of bi-component fibers and/or multi-component fibers comprising more than two components can be used in the present invention, as can single component fibers.

In certain embodiments, it may be desirable to redistribute at least some of the synthetic fibers 101 in the web 100 after the web 100 is formed. Such redistribution can occur while the web 100 is disposed on the molding member 50 or at a different time and/or location in the process. For example, a heating apparatus 90, the drying surface 210 and/or a drying drum's hood (such as, for example, a Yankee's drying hood 80) can be used to heat the web 100 after it is formed to redistribute at least some of the synthetic fibers 101. Without wishing to be bound by theory, it is believed that the synthetic fibers 101 can move after application of a sufficiently high temperature, under the influence of at least one of two phenomena. If the temperature is sufficiently high to melt the synthetic fiber 101, the resulting liquid polymer will tend to minimize its surface area/mass, due to surface tension forces, and form a sphere-like shape at the end of the portion of fiber that is less affected thermally. On the other hand, if the temperature is below the melting point, fibers with high residual stresses will soften to the point where the stress is relieved by shrinking or coiling of the fiber. This is believed to occur because polymer molecules typically prefer to be in a non-linear coiled state. Fibers that have been highly drawn and then cooled during their manufacture are comprised of polymer molecules that have been stretched into a meta-stable configuration. Upon subsequent heating, the fibers attempt to return to the minimum free energy coiled state.

Redistribution may be accomplished in any number of steps. For example, the synthetic fibers 101 can first be redistributed while the fibrous web 100 is disposed on the molding member 50, for example, by blowing hot gas through the pillows of the web 100, so that the synthetic fibers 101 are redistributed according to a first pattern. Then, the web 100 can be transferred to another molding member 50 wherein the synthetic fibers 101 can be further redistributed according to a second pattern.

Heating the synthetic fibers 101 in the web 100 can be accomplished by heating the plurality of micro-regions corresponding to the fluid-permeable areas 154 of the molding member 50. For example, a hot gas from the heating apparatus 90 can be forced through the web 100. Pre-dryers can also be used as the source of heat energy. In any case, it is to be understood that depending on the process, the direction of the flow of hot gas can be reversed relative to that shown in FIG. 1, so that the hot gas penetrates the web through the molding member 50. Then, the pillow portions 150 of the web that are disposed in the fluid-permeable areas 154 of the molding member 50 will be primarily affected by the hot gas. The rest of the web 100 will be shielded from the hot gas by the molding member 50. Consequently, the synthetic fibers 101 will be softened or melted predominantly in the pillow portions 150 of the web 10. Further, this region is where co-joining of the fibers due to melting or softening of the synthetic fibers 101 is most likely to occur.

Although the redistribution of the synthetic fibers 101 has been described above as having been affected by passage of hot gas over at least a portion of some of the fibers 101, any suitable means for heating the fibers 101 can be implemented. For example, hot fluids may be used, as well as microwaves, radio waves, ultrasonic energy, laser or other light energy, heated belts or rolls, hot pins, magnetic energy, or any combination of these or other known means for heating. Further, although redistribution of the synthetic fibers 101 has generally been referred to as having been affected by heating the fibers 101, redistribution may also take place as a result of cooling a portion of the web 10. As with heating, cooling of the synthetic fibers 101 may cause the fibers 101 to change shape and/or reorient themselves with respect to the rest of the web. Further yet, the synthetic fibers may be redistributed due to a reaction with a redistribution material. For example, the synthetic fibers 101 may be targeted with a chemical composition that softens or otherwise manipulates the synthetic fibers 101 so as to affect some change in their shape, orientation or location within the web 10. Further yet, the redistribution can be affected by mechanical and/or other means such as magnetics, static electricity, etc. Accordingly, redistribution of the synthetic fibers 101, as described herein, should not be considered to be limited to just heat redistribution of the synthetic fibers 101, but should be considered to encompass all known means for redistributing (e.g. altering the shape, orientation or location) of any portion of the synthetic fibers 101 within the web 10.

Figure 10:
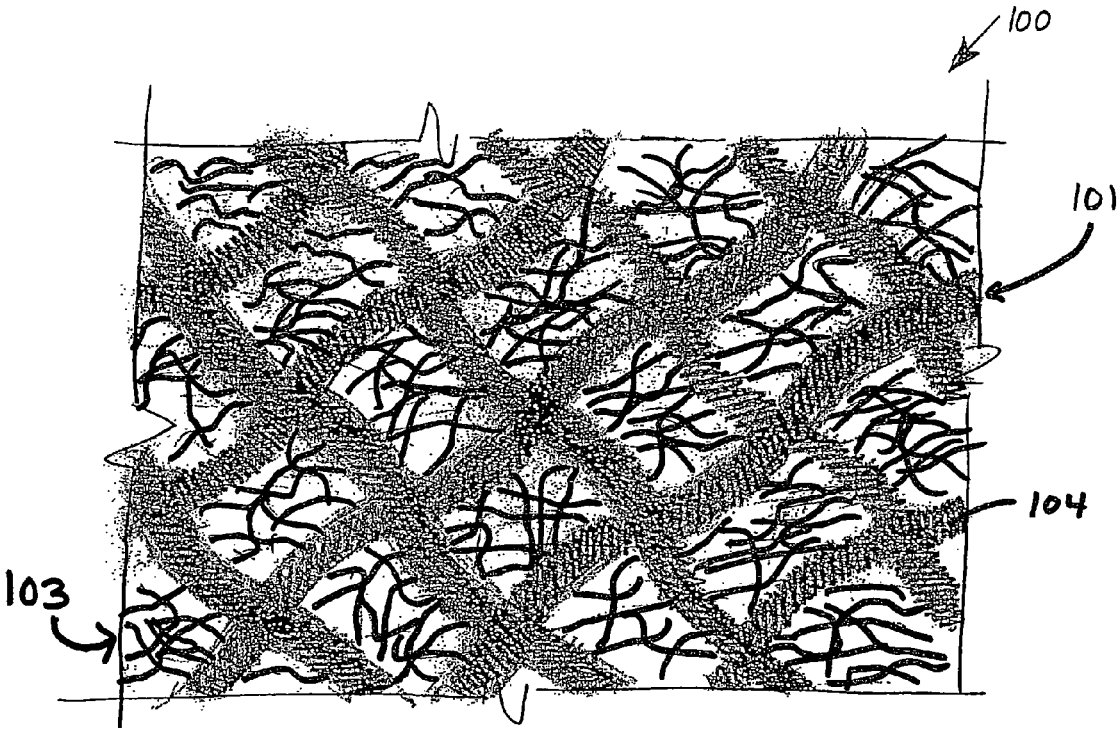
FIG. 10 is a schematic plan view of an embodiment of the unitary fibrous structure of the present invention.

While the synthetic fibers 101 may be redistributed in a manner and by means described herein, the process for producing the web can be selected such that the distribution of the long cellulosic fibers 103 and/or short cellulosic fibers 102 is not significantly affected by the means used to redistribute the synthetic fibers 101. Thus, the resulting fibrous structure 100 whether redistributed or not may comprise a plurality of long cellulosic fibers 103 randomly distributed throughout the fibrous structure and a plurality of synthetic fibers 101 distributed in a non-random pattern. FIG. 10 shows one embodiment of the fibrous structure 100 wherein the long cellulosic fibers 103 are randomly distributed throughout the structure, and the mixture 104 of synthetic fibers 101 and short cellulosic fibers 102 are distributed in a non-random repeating pattern.

The method of making the web of the present invention may also include any other desired steps. For example, the method may include converting steps such as winding the web onto a roll, calendering the web, embossing the web, perforating the web, printing the web and/or joining the web to one or more other webs or materials to form multi-ply structures. Some exemplary patents describing embossing include U.S. Pat. Nos. 3,414,459; 3,556,907; 5,294,475 and 6,030,690. In addition, the method may include one or more steps to add or enhance the properties of the web such as adding softening, strengthening and/or other treatments to the surface of the product or as the web is being formed. Further, the web may be provided with latex or the like, for example, as described in U.S. Pat. No. 3,879,257 or otherwise.

A variety of products can be made using the fibrous structure 100 of the present invention. For example, the resultant products may find use in filters for air, oil and water; vacuum cleaner filters; furnace filters; face masks; coffee filters, tea or coffee bags; thermal insulation materials and sound insulation materials; nonwovens for use in sanitary products such as diapers, feminine pads, and incontinence articles; textile fabrics for moisture absorption and softness of wear such as microfiber or breathable fabrics; electrostatically charged, structured webs for collecting and removing dust; reinforcements and webs for hard grades of paper, such as wrapping paper, writing paper, newsprint, corrugated paper board, and webs for tissue grades of paper such as toilet paper, paper towel, napkins and facial tissue; medical uses such as surgical drapes, wound dressing, bandages, and dermal patches. The fibrous structure 100 may also include odor absorbents, termite repellents, insecticides, rodenticides, and the like, for specific uses. The resultant product may absorb water and oil and may find use in oil or water spill clean-up, or controlled water retention and release for agricultural or horticultural applications.

Non-Limiting Examples:

EXAMPLE 1

A pilot scale Fourdrinier papermaking machine is used in the present example. A 3% by weight aqueous slurry of NSK is made up in a conventional re-pulper. The NSK slurry is refined gently and a 2% solution of a permanent wet strength resin (i.e. Kymene 557LX marketed by Hercules incorporated of Wilmington, Del.) is added to the NSK stock pipe at a rate of 1% by weight of the dry fibers. The adsorption of Kymene 557LX to NSK is enhanced by an in-line mixer. A 1% solution of Carboxy Methyl Cellulose (CMC) is added after the in-line mixer at a rate of 0.2% by weight of the dry fibers to enhance the dry strength of the fibrous substrate. A 3% by weight aqueous slurry Eucalyptus fibers is made up in a conventional re-pulper.

The NSK furnish and the Eucalyptus fibers are layered in the head box and deposited onto a Fourdrinier wire as different layers to form an embryonic web. Dewatering occurs through the Foudrinier wire and is assisted by a deflector and vacuum boxes. The Fourdrinier wire is of a 5-shed, satin weave configuration having 84 machine-direction and 76 cross-machine-direction monofilaments per inch, respectively. The embryonic wet web is transferred from the Fourdrinier wire, at a fiber consistency of about 22% at the point of transfer, to a photo-polymer fabric having 150 Linear Idaho cells per square inch, 20 percent knuckle areas and 17 mils of photo-polymer depth. Further de-watering is accomplished by vacuum assisted drainage until the web has a fiber consistency of about 28%. The patterned web is pre-dried by air blow-through to a fiber consistency of about 65% by weight. The web is then adhered to the surface of a Yankee dryer with a sprayed creping adhesive comprising 0.25% aqueous solution of Polyvinyl Alcohol (PVA). The fiber consistency is increased to an estimated 96% before the dry creping the web with a doctor blade. The doctor blade has a bevel angle of about 25 degrees and is positioned with respect to the Yankee dryer to provide an impact angle of about 81 degrees; the Yankee dryer is operated at about 600 fpm (feet per minute) (about 183 meters per minute). The dry web is formed into roll at a speed of 560 fpm (171 meters per minutes).

Two plies of the web are formed into paper towel products by embossing and laminating them together using PVA adhesive. The paper towel has about 40 g/m$^2$ basis weight and contains 70% by weight Northern Softwood Kraft and 30% by weight Eucalyptus furnish. The resulting paper towel has an aged wet burst of about 374 grams.

EXAMPLE 2

A paper towel is made by a method similar to that of Example 1, but replacing 10% by weight of Eucalyptus by 10% by weight of 3 mm synthetic bicomponent polyester fibers. The synthetic-Eucalyptus mixture has the fiber length ratio of 4.2, a PTP factor of 1.2 and a coarseness value of 11.0 mg/100 m. The fiber length ratio, PTP factor and coarseness values are determined by the Kajaani procedure set forth in the Test Methods section, below. The paper towel has about 40 g/m$^2$ basis weight and contains 70% by weight Northern Softwood Kraft in one layer and a mixture of 20% by weight Eucalyptus and 10% by weight of the 3 mm long synthetic fibers in the other layer. The resulting paper towel has an aged wet burst of about 484 grams.

EXAMPLE 3

A paper towel is made by a method similar to that of Example 1, but replacing 5% by weight of Eucalyptus by 5% by weight of 6 mm synthetic bicomponent polyester fibers. The synthetic-Eucalyptus mixture has a fiber length ratio of 8.4, a PTP factor of 1.2 and a coarseness value of 11.6 mg/100 m, measured as described in Example 2, and as set forth in the Test Methods section, below. The paper towel has about 40 g/m$^2$ basis weight and contains 70% by weight Northern Softwood Kraft in one layer and a mixture of 25% by weight Eucalyptus and 5% by weight of the 6 mm long synthetic fibers in the other layer. The resulting paper towel has an aged wet burst of about 472 grams.

Test Methods:

Kajaani Procedure:

The length weighted average fiber length of cellulosic fibers and the coarseness of the cellulosic-synthetic fiber mix are determined with a Kajaani FiberLab fiber analyzer. The analyzer is operated according to the manufacturer's recommendations with the report range set at 0 mm to 7.6 mm and the profile set to exclude fibers less than 0.08 mm in length from the calculation of fiber length and coarseness. Particles of this size are excluded from the calculation because it is believed that they consist largely of non-fiber fragments that are not functional for the uses toward that the present invention is directed.

Care should be taken in sample preparation to assure an accurate sample weight is entered into the Kajaani FiberLab instrument. An acceptable method for sample preparation has the following steps:

1) Determine the sample moisture content and then weigh out the sample for analysis. The target sample weight for short hardwood fibers is 0.02-0.04 grams and 0.15-0.30 grams for common long softwood fibers. Samples should be weighed at +/−0.1 milligram accuracy for the coarseness analysis.
2) Disintegrate the dry sample by filling the manual disintegrator with about 150 mls of warm water, adding the dry sample and moving the disintegrator's dasher up and down until the sample is completely disintegrated, that is no fiber bundles or bonds remain in the sample. However, longer than necessary disintegration times and too rough handling of the fibers should be avoided such that the fibers do not break.
3) Transfer the pulp slurry in the manual disintegrator to a 2000 ml volumetric flask and fill to the 2000 ml mark with tap water. Mix well to achieve uniformity. Dilution accuracy should be +/−4 mls for coarseness samples.
4) Determine the sample's consistency and calculate the required sample amount using the following equation: sample amount=(target consistency×2000)/(process consistency), where target consistency for hardwoods is 0.005-0.010% and for softwoods 0.015-0.025%.
5) Add the sample amount to a 2000 ml volumetric flask and fill to the 2000 ml mark with tap water and mix well.
6) Take 50 mls aliquot of the sample slurry using a pipette with a tip opening of at least 2 mm and place the aliquot into the Kajaani sample container.
7) For coarseness analysis, calculate the total sample weight present in the 50 ml aliquot using the following equation: weight of fibers in 50 ml aliquot (mg/50 ml)=(50 ml/2000 ml)×(dry weight of weighed fibers, mg)
8) Place the sample container in the Kajaani sample unit and start the analysis.
9) The Kajaani FiberLab equipment automatically reports the length weighted average fiber length in millimeters, average cellulosic fiber width in micrometers and coarseness in milligram/meter. The Kajaani FiberLab equipment reports the coarseness in units of milligrams per meter of unweighted fiber length (mg/m). This value is multiplied by 100 to get the coarseness in units of milligrams per hundred meters, as set forth in the definition of coarseness, above. The coarseness of the pulp is an average of three coarseness measurements of three fiber specimens taken from the mix.

Aged Wet Burst:

Wet burst is determined using a Thwing-Albert Burst tester cat. No. 177, equipped with a 2000 grams load cell, obtained from Thwing-Albert Instrument Co., 10960 Dutton Road, Philadelphia, Pa. 19154. The samples are placed in a conditioned room at a temperature of about 73 degrees +/−2 degrees Fahrenheit and about 50% +/−2% relative humidity for at least about 24 hours. The paper is aged for about 5 minutes in an oven at 105 degrees Centigrade. A paper cutter is used to cut eight strips approximately 4.5 inches wide (CD) by 12 inches long (MD) for testing. Each strip is wetted with distilled water and placed on the lower ring of the sample holding device with the wire side facing up so the sample completely covers the opening in the lower ring and a small amount of sample extends over the outer diameter of the lower ring. After the sample strip is properly in place on the lower ring, the upper ring is lowered with the pneumatic holding device so that the sample is held between the upper and lower rings. The diameter of the opening in the lower ring is about 3.5 inches. The plunger has a diameter of about 0.6 inches. The tester is activated, so that the plunger rises at a speed of about 5 inches per minute and ruptures the paper. The tester provides the value of wet burst strength directly in grams at the time of sample rupture. The test results obtained for the eight sample strips are averaged and the wet burst value of the paper sample is recorded to the nearest gram.

All documents cited herein are, in relevant part, incorporated herein by reference; the citation of any document is not to be construed as an admission that it is prior art with respect to the present invention. While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

The invention claimed is:

1. A method for making a fibrous structure, the method comprising the steps of:

providing a mixture of synthetic fibers and short cellulosic fibers onto a forming member so as to form one or more layers including the mixture of synthetic fibers and short cellulosic fibers;

providing a plurality of long cellulosic fibers onto the mixture of synthetic fibers and short cellulosic fibers so as to form one or more layers including predominantly long cellulosic fibers to form an embryonic web;

forming a unitary fibrous structure including the one or more layers including the mixture of synthetic fibers and short cellulosic fibers and one or more layers including predominantly long cellulosic fibers from the embryonic web;

transferring the unitary fibrous structure to a molding member comprising a pl fluid-permeable areas present in a pattern and a plurality of fluid-impermeable areas; and redistributing at least some of the synthetic fibers within the unitary fibrous structure by heating the synthetic fibers within the fluid-permeable areas of the molding member resulting in a pattern of micro-regions of synthetic fibers corresponding to the fluid-permeable areas of the molding member.

2. The method of claim 1 wherein the mixture of synthetic fibers and short cellulosic fibers have a fiber length ratio greater than about 1.

3. The method of claim 1, wherein the mixture of synthetic fibers and short cellulosic fibers have a fiber length ratio between about 1 and about 20.

4. The method of claim 1 wherein the mixture of and synthetic fibers and short cellulosic fibers has a coarseness value of less than about 50 mg/100 m.

5. The method of claim 1, further including the step of impressing the fibrous structure between a molding member and a pressing surface to densify portions of the fibrous structure.

6. The method of claim 1 wherein the forming member is moving at a first velocity and the method further includes the steps of:

providing a second member at a second velocity that is less than the first velocity; and transferring the embryonic web from the forming member to the second member so as to microcontract the embryonic web.

7. The method of claim 1 wherein the unitary fibrous structure is creped, uncreped or embossed.

8. The method of claim 1 including the further step of providing latex to at least a portion of at least one surface of the unitary fibrous structure.

9. A method for making a fibrous structure, the method comprising the steps of:

providing a mixture of synthetic fibers and short cellulosic fibers onto a forming member comprising a plurality of fluid-permeable areas present in a pattern and a plurality of fluid-impermeable areas, wherein the fluid-permeable areas form a pattern of channels, the mixture provided such that at least some of the synthetic fibers are disposed in the channels;

providing a plurality of long cellulosic fibers onto the mixture of synthetic fibers and short cellulosic fibers such that the long cellulosic fibers are disposed adjacent to the synthetic fibers to form an embryonic web;

forming a unitary fibrous structure from the embryonic web;

transferring the unitary fibrous structure to a molding member comprising a plurality of fluid-permeable areas present in a pattern and a plurality of fluid-impermeable areas, wherein the fluid-permeable areas form a pattern of channels; and redistributing at least some of the synthetic fibers by heating the synthetic fibers within the fluid-permeable areas of the molding member resulting in a pattern of micro-regions of synthetic fibers corresponding to the fluid-permeable areas of the molding member.

10. The method of claim 9 wherein the mixture of synthetic fibers and short cellulosic fibers is provided onto the forming member before the plurality of long cellulosic fibers are provided.

11. The method of claim 9 further including the step of impressing the fibrous structure between the molding member and a pressing surface to densify portions of the fibrous structure.

12. The method of claim 9 wherein the forming member is moving at a first velocity and the method further includes the steps of:

providing a second member at a second velocity that is less than the first velocity; and transferring the embryonic web from the forming member to the second member so as to microcontract the embryonic web.

13. The method of claim 9 wherein the unitary fibrous structure is creped, uncreped or embossed.

14. The method of claim 9 including the further step of providing latex to at least a portion of at least one surface of the unitary fibrous structure.

15. The method of claim 9 wherein the mixture of synthetic fibers and short cellulosic fibers have a fiber length ratio greater than about 1.

16. The method of claim 9, wherein the mixture of synthetic fibers and short cellulosic fibers have a fiber length ratio between about 1 and about 20.

17. The method of claim 9 wherein the mixture of and synthetic fibers and short cellulosic fibers has a coarseness value of less than about 50 mg/100 m.

18. A method for making a unitary fibrous structure, comprising the steps of:

providing a first aqueous slurry comprising a mixture of synthetic fibers and short cellulosic fibers;

providing a second aqueous slurry comprising a plurality of long cellulosic fibers;

depositing the first and second aqueous slurries onto a forming member comprising a plurality of fluid-permeable areas present in a pattern and a plurality of fluid-impermeable areas, wherein the fluid-permeable areas form a pattern of channels;

partially dewatering the deposited first and second slurries to form an embryonic web comprising the plurality of long cellulosic fibers randomly distributed throughout at least one layer of the fibrous web and the mixture of synthetic fibers and short cellulosic fibers at least partially non-randomly distributed in the channels;

forming a unitary fibrous structure from the embryonic web;

transferring the unitary fibrous structure to a molding member comprising a plurality of fluid permeable areas present in a pattern and a plurality of fluid impermeable areas, wherein the fluid-permeable areas form a pattern of channels;

applying a fluid pressure differential to the unitary fibrous structure disposed on the molding member, thereby molding the unitary fibrous structure according to the pattern of channels, wherein the unitary fibrous structure disposed on the molding member comprises a first plurality of micro-regions corresponding to a plurality of fluid-permeable areas of the molding member and a second plurality of micro-regions corresponding to a plurality of fluid-impermeable areas of the molding member;

redistributing at least some of the synthetic fibers by heating the synthetic fibers within the fluid-permeable areas of the molding member resulting in a pattern of micro-regions of synthetic fibers corresponding to the fluid-permeable areas of molding member; and transferring the unitary fibrous structure from the molding member to a drying surface.

* * * * *